United States Patent [19]

Boatright

[11] Patent Number: 4,535,991

[45] Date of Patent: Aug. 20, 1985

[54] ISOMETRIC GOLF TRAINER DEVICE AND METHOD

[76] Inventor: Edward Boatright, 1805 Lawrence, Springdale, Ark. 72764

[21] Appl. No.: 548,951

[22] Filed: Nov. 7, 1983

[51] Int. Cl.[3] ..... A63B 69/36

[52] U.S. Cl. ..... 273/193 A; 273/191 B; 273/187 A; 272/125

[58] Field of Search ..... 273/191 B, 187 A, 26 B, 273/186 A; 272/125, 134, 93, 124

[56] References Cited

U.S. PATENT DOCUMENTS

| | | | |
|---|---|---|---|
| 1,137,349 | 4/1915 | Patterson | 273/191 B X |
| 2,455,707 | 12/1948 | Sheffer | 273/191 B |
| 3,618,942 | 11/1971 | Bates | 272/136 |
| 3,677,543 | 7/1972 | Richardson | 273/191 B X |
| 3,868,109 | 2/1975 | Fowler | 273/187 A |
| 4,353,556 | 10/1982 | Self et al. | 273/191 B |

*Primary Examiner*—George J. Marlo
*Attorney, Agent, or Firm*—Robert R. Keegan

[57] ABSTRACT

There is disclosed an isometric training device for golfers to improve driving distance and accuracy including a conventional golf club shaft having an elongated head member secured at the bottom of the shaft where the club head normally would be and inclined at an angle of about 125 degrees to the shaft. The elongated head may be about nine inches in length and is provided with holes for attaching a flexible generally inextensible cord at various positions therealong including two positions to the rear of the junction of the shaft with the elongated head. The device is used by attaching a cord between a stationary object such as a table leg and a selected one of the holes in the elongated head and, in accordance with instructions, orienting the head on the floor in a normal driving position at a selected angle with the cord; stress is imparted to muscles by acting against the restraint of the anchored cord. A guide on flat sheet material is provided for determining the angle between the head and the cord by indicia marked thereon.

3 Claims, 5 Drawing Figures

ISOMETRIC GOLF TRAINER DEVICE AND METHOD

The present invention relates to training devices for use in improvement of a golfer's driving technique and particularly to such apparatus of the isometric training rather than dynamic training type. It should be understood that a dynamic training device customarily involves the trainee going through the motion of a golf swing in the presence of certain controls, measurements, or evaluations. On the other hand, in using an isometric training device the trainee is essentially motionless while putting certain muscles under stress, the nature of such stress being controlled by the training device. Golf trainer devices previously known have been generally of the dynamic type and the characteristics of such devices have been substantially different than the characteristics of the present isometric golf training device. The present device includes a conventional golf club shaft with an elongated head member which is tethered to a fixed object such as a table leg; the place of attachment of the tether on the elongated head member, and the direction of the tether and the anchor point from the head member are determined to place the desired nature of stress on the muscles of the trainee.

The previously known dynamic golf training devices have included devices in which the golf club head was provided with or replaced by means for cooperating with a guiding and restraining apparatus including a flexible cord to control the dynamic motion of a golfer's swing. An example of such dynamic golf training apparatus may be seen in U.S. Pat. No. 3,917,281 to Oppenheimer. Other golf training devices have employed cords which attach to the golfer's body, arms or legs as may be seen in the U.S. Pat. to Arena, No. 4,134,589. These prior devices are quite different than the present apparatus for isometric training; the present apparatus is arranged so that in a static condition there are reactive forces to the golfer's muscle action; these include forces which resist all body motions tending to accelerate the club head and also forces which tend to rotate the golfer's hands and wrists. Adjustments in use of the apparatus permit the magnitude and direction of the forces reacting against the muscular force of the golfer to be controlled to attain the desired results in altering the golfer's swing and the golfer's performance in driving a golf ball.

In addition to providing the above described features and advantages it is an object of the present invention to provide isometric golf training apparatus wherein a golf club shaft in the hands of the golfer has reactive forces applied thereto by a tether connected to an anchor element, and in which adjustments may be made to change the magnitude and/or direction of torque applied to the golf shaft tending to rotate the golf club handle.

It is another object of the present invention to provide such a device in which the direction of reactive force resisting the arcuate motion of the golf club head may be adjusted in a measured and controlled manner.

It is still another object of the present invention to provide isometric training apparatus permitting the golfer to assume a stance with the simulated golf club shaft in a position generally corresponding to the ball impact position, and having the capability of imparting resistive force to the simulated golf club shaft having a torque component and a linear component which are adjustable in relative magnitude and in direction.

Other objects and advantages of the invention will be apparent from consideration of the following description in conjunction with the appended drawings in which.

Figures 1, 2:
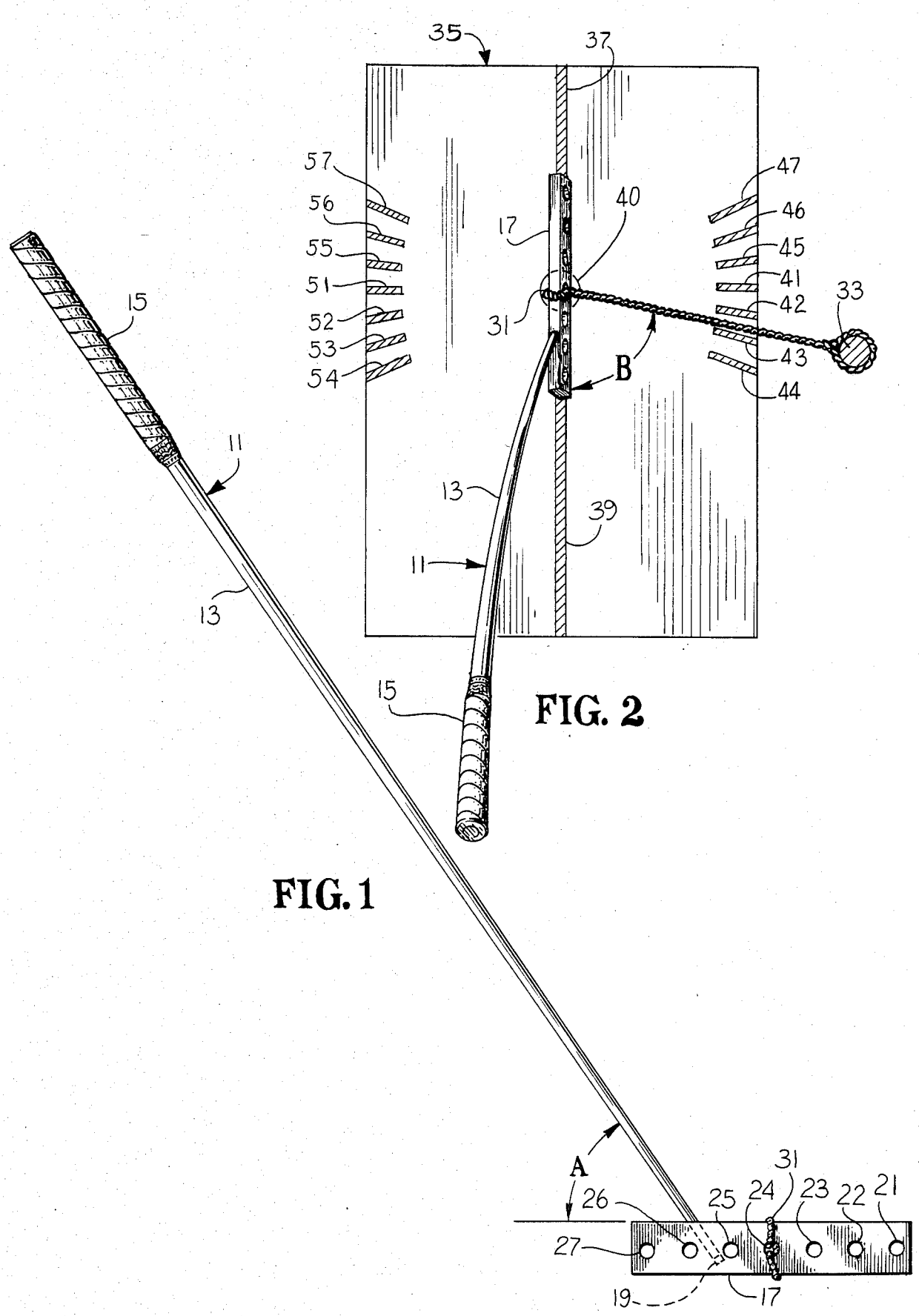
FIG. 1 is an elevational view of an isometric golf trainer device according to the invention.
FIG. 2 is a top plan view thereof showing the orientation of the tether with respect to the elongated head together with the locator panel which aids in locating the elongated head relative to the tether anchor point.

Referring now to the drawings and particularly to FIG. 1 and FIG. 2, an isometric training device 11 has a shaft 13 which may be a standard stiff-flex golf club shaft which is resistant to breaking or warping. The top of shaft 13 is provided with a standard golf grip 15 while in place of a driving head at the lower end of shaft 13 there is an elongated head 17 which may be conveniently made of solid wood. Elongated head 17 may also be made of plastic, laminated wood or other material; preferably the weight of elongated head 17 will be roughly similar to a driver club head such as a number one or a number two wood.

Elongated head 17 is preferably attached by providing it with a hole 19 shown in dashed lines in FIG. 1 wherein the lower end of shaft 13 is cemented in place with a suitable adhesive. This will prevent rotation of elongated head 17 with respect to shaft 13 even when substantial torque is transmitted to the junction therebetween.

A series of holes 21 through 27 are located equally spaced along elongated head 17 with a center to center distance of about one and one-half inches. The holes 21–27 may be five-eighths inch in diameter and the overall length of elongated head 17 is a little more than nine inches. The spacing of holes 21–27 and their diameter is not particular critical, but the outermost hole is preferably about four to six inches from the shaft.

It will be noted that the elongated head extends about two inches to the rear of shaft 13, and hole 27 is located to the rear of the junction between shaft 13 and elongated head 17. This hole 27 will be used infrequently and may optionally be omitted from the device, in which case the extension of the elongated head 17 to the rear of the shaft 13 may be shortened. The height of the elongated head 17 is about two inches in the illustrated embodiment but this dimension is of no particular relevance. A greater or lesser number of holes such as holes 21–27 may be provided or other means may be provided in head 17 such as notches, eyes, rings or the like for locating a tether 31 at a predetermined position along the length of elongated head 17.

Tether 31 is illustrated as a quarter-inch nylon cord secured in the form of a loop, the doubled length of which is about two feet long. Tether 31 is preferably of three-sixteenths to one-quarter inch diameter with a breaking strength of at least fifty to one-hundred pounds. Tether 31 is preferably relatively inextensible under the forces to which it is subjected. Specifically, the nylon cord forming the tether 31 preferably will not stretch more than ten percent when subjected to a force of ten pounds.

Figure 3:
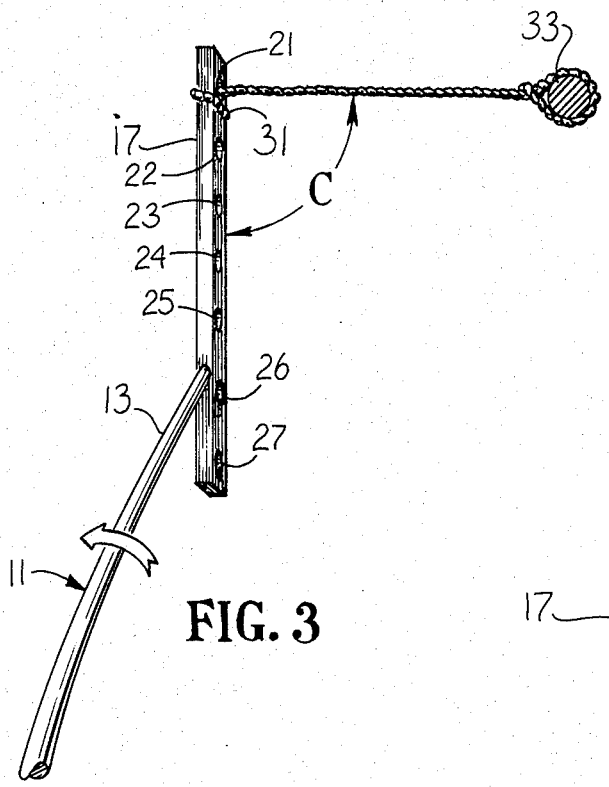
FIG. 3 is a top plan view of the apparatus of FIG. 1 with a different tether orientation.
Figure 4:
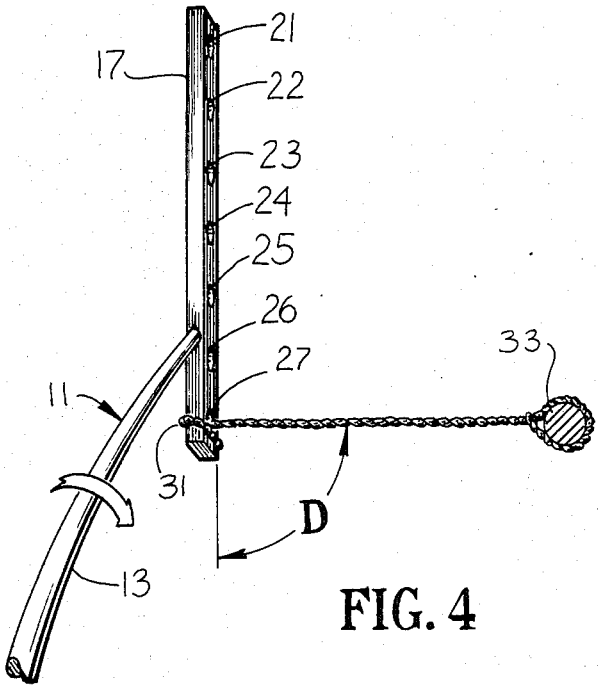
FIG. 4 is a top plan view of the apparatus of FIG. 1 with another different tether orientation.
Figure 5:
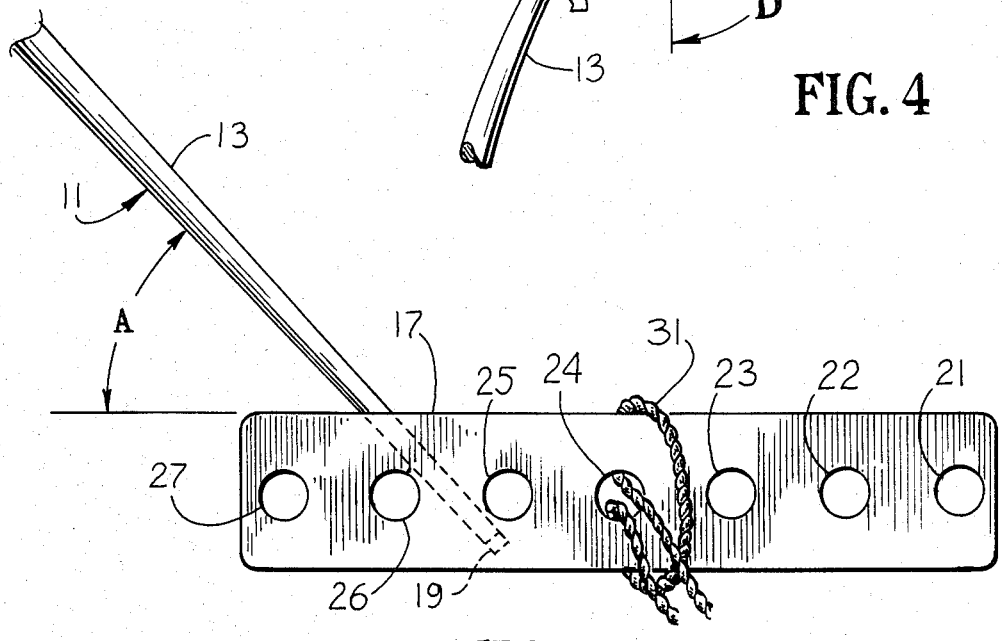
FIG. 5 is an enlarged detail of the elongated head of the apparatus of FIG. 1.

The use of the apparatus will be better understood by reference to FIGS. 2 through 4 in conjunction with FIGS. 1 and 5. As seen in FIG. 2, the elongated head in use rests on or just above the floor; under the elongated head 17 there is a rectangular panel of sheet material 35 at least about one foot long by about one-half foot wide. Panel 35 may be formed of a plastic or reinforced plastic such as a polyvinyl acetate or a vinyl acetate or a vinyl chloride. Alternatively a material such as plastic coated paper or paper board might be used for panel 35. Panel 35 has various indicia embossed thereon including a center mark 40 and right side angle marks 41 through 47. Angle mark 41 would indicate a right angle relation between the tether 31 and the elongated head 17.

Tether 31 is shown looped around a table leg 33 as an anchor. Any suitable, relatively thick object may be used in place of table leg 33 as an anchor for tether 31. Right side angle marks 42, 43, and 44 show decreasing angle relationships between tether 31 and elongated head 17 while right side angle marks 45, 46, and 47 show increasing angle relationships between tether 31 and elongated head 17. Head guide marks 37 and 39 aid in aligning the elongated head 17 parallel with the axis of sheet material 35.

FIG. 2 shows the orientation of the apparatus as it would be used by a right-handed golfer. Left side angle marks 51 through 57 are provided for left-handed golfers with marks 52, 53, and 54 being the decreasing angle marks and the marks 55, 56, and 57 being increasing angle marks.

In the use of the device according to the invention, the user consults the instructions to first determine the appropriate way to attach the tether to the elongated head. Of course the tether must also be secured to an appropriate anchor as by looping it or tying it to a leg of a table or other substantial piece of furniture.

Selection of a hold from holes 21–27 for connection of tether 31 determines whether the hand-rotation effort of the golfer is clockwise, counter-clockwise, or neutral. Referring to FIG. 3 it will be seen that the tether 31 is placed in hole 21 and (for a right-handed golfer) hand-rotation effort is counter-clock wise. Selection of the hole determines the relative degree of hand-rotation effort and selection of hole 21 as in FIG. 3 produces the maximum degree of hand-rotation effort in the counter-clockwise direction.

Placement of the tether as shown in FIG. 3 in hole 21 would accordingly promote maximum hand rotation which would be helpful in correcting the swing of a golfer with a very aggravated slice. This is accomplished by increasing the hand-rotation strength to aid in getting the club face closed through the golf swing. Hole number 22 would be used to correct a moderate slice problem and hole number 23 would be utilized for a driver swing that produced a minimal slice or a fade drive. Hole number 24 corresponds roughly to the center of the golf club head and is approximately neutral in regard to slice or hook direction.

Referring to FIG. 4 the position of the apparatus is shown with tether 31 secured in hole 27. With this arrangement the hand-rotation effort of the trainee is clockwise and is thus disposed to decrease normal hand-rotation in the golf swing and thereby correct the golf swing of a golfer with a hook problem. Maximum clockwise hand-rotation effort is produced by placing the tether in hole 27 whereas lesser degrees of clockwise hand effort are induced by placement of the tether in holes 26 and 25 so that hole 26 is suitable for a large hook problem which is still not quite the maximum, and hole 25 is suitable for a golfer with a drive stroke producing somewhat more of a hook than is desired. The previous discussion has all dealt with problems in golf swing attributable to an excessively open clubface-ball contact or an excessively closed clubface-ball contact.

Inaccuracy in the golf swing can also result from the arc of the club head rather than the orientation of the club head in the rotation mode, and adjustments can be made in the arc of the golfer's swing in a manner indicated in FIG. 2.

It will be there noted that the tether is connected in hole 24 and consequently little or no correction of golf clubface orientation is desired. On the other hand the elongated head 17 is arranged with respect to anchor 33 so that the tether 31 is not at right angles to elongated head 17 as was the case in FIGS. 3 and 4. Rather the tether 31 is at a slightly acute angle aligned approximately with right hand mark 43.

The result of isometric exercise and training in the configuration shown in FIG. 2 is to produce an inside to out swing path and thus promote a slight hook shot. Conversely, aligning the tether 31 at an obtuse angle on marks 45, 46, or 47 would have a tendency to decrease the insideout character of the swing and to decrease a hooking tendency in the swing or to promote a slight fade in the golfer's drive. It will be apparent that a left-handed golfer can arrange the tether 31 to the opposite side and utilize left side markers 51 through 57.

Through self-analysis or with the assistance of evaluation from an observer the golfer can determine the characteristic of his drive which he wishes to change and then select from the numerous combination of swing directions and desired amounts of hand-rotation the needed isometric exercise and muscle strengthening which will improve his golf swing. As the golf swing improves he may then make adjustments in the use of the isometric exercise apparatus according to the invention to avoid overcorrecting his particular problem.

If performed on a regular basis such as twice a day, morning and evening, less than a minute of isometric training will produce observable changes in the golfer's swing and enable him to work toward the improvements which he desires.

From the foregoing explanation and discussion it will be seen that apparatus of a relatively simple nature which can readily be employed in any home or office environment is provided to implement desired changes in golf driving technique. It has been mentioned that the manner of adjustable attachment of the tether 31 to the elongated head 17 is subject to variation, and it should be noted that tether 31 could be replaced by any form of restraint of either a flexible or rigid nature, and the method of attachment thereof to an anchor and to the elongated head 17 is also subject to wide variation.

In addition to the variations and modifications of the apparatus suggested or described above, other variations and modifications will be apparent to those skilled in the art and accordingly the scope of the invention is not to be considered limited to the particular embodiments shown or suggested, but is rather to be determined by reference to the appended claims.

What is claimed is:

1. An isometric training device for golfers comprising a shaft between 36 and 48 inches long having a longitudinal axis, a handle at the top of said shaft, an elongated head rigidly secured at the bottom end of said shaft at an angle of from 115° to 135° thereto, said head being formed of substantially rigid, inflexible material and extending from said shaft, a substantially inextensible tie element for connecting said head to a stationary object near floor level, said tie element having an extensibility of less than 1 inch for 10 pounds force, and means for securing said tie element to said head at selectively different fixed distances from the axis of said shaft including a first opening in the rigid material of said elongated head spaced from said shaft axis a predetermined distance and a second opening in said rigid material spaced a lesser distance from said axis than said first opening, whereby the torque transmitted to said shaft through said elongated head may be adjusted for different isometric training procedures.

2. Apparatus as recited in claim 1 wherein said tie element includes a flexible cord.

3. Apparatus as recited in claim 1 wherein said angle is about 125°.

* * * * *